US005480200A

United States Patent [19]

Aintablian

[11] Patent Number: 5,480,200

[45] Date of Patent: Jan. 2, 1996

[54] PORTABLE AUXILIARY DOOR LOCK

[76] Inventor: David Aintablian, 16 Simcoe Street South, Oshawa, Ontario, L1H 4G2, Canada

[21] Appl. No.: 302,295

[22] Filed: Sep. 8, 1994

[30] Foreign Application Priority Data

Sep. 10, 1993 [CA] Canada ..... 2099034

[51] Int. Cl.[6] ..... E05C 19/18

[52] U.S. Cl. ..... 292/288; 292/292

[58] Field of Search ..... 292/289, 292, 292/293, 294, 290, 256.71, 258, 288

[56] References Cited

U.S. PATENT DOCUMENTS

| | | | |
|---|---|---|---|
| 628,735 | 7/1899 | Wold | 292/292 |
| 1,166,692 | 1/1916 | Kennedy | 292/292 |
| 1,467,057 | 9/1923 | Moglich . | |
| 1,598,081 | 8/1926 | Japs . | |
| 1,671,454 | 5/1928 | Stoutenburgh . | |
| 1,869,689 | 8/1932 | Holland . | |
| 3,039,806 | 6/1962 | Rice | 292/293 |
| 3,316,005 | 4/1967 | Oesler | 292/296 |
| 3,352,587 | 11/1967 | Harvey . | |
| 3,421,787 | 1/1969 | Hoffman et al. | 292/289 |
| 3,633,955 | 1/1972 | Read | 292/292 |
| 3,726,555 | 4/1973 | Lawson | 292/291 |
| 3,914,965 | 10/1975 | Paxton . | |
| 4,575,140 | 3/1986 | Dargis | 292/288 |
| 4,605,251 | 8/1986 | Finlay | 292/288 |
| 4,770,451 | 9/1988 | Souza | 292/289 |
| 5,193,867 | 3/1993 | Husted | 292/292 |

FOREIGN PATENT DOCUMENTS

| | | | |
|---|---|---|---|
| 605540 | 5/1926 | France | 292/292 |
| 35249 | 7/1922 | Norway | 292/292 |

*Primary Examiner*—Rodney M. Lindsey
*Attorney, Agent, or Firm*—Bereskin & Parr

[57] ABSTRACT

A portable auxiliary locking device for use with a door hung in a door jamb having a latch hole for receiving a horizontally extendible latch bolt. The locking device includes a plate thin enough to fit in the gap between the door and the doorjamb and long enough to extend inside the door and the doorjamb when the door is closed. The plate has at least one vertical slot and a tongue extending transversely from one end of the plate dimensioned to fit within the latch hole. A cross plate slides into a slot in the plate until a notch on the bottom edge of the cross plate engages the plate and locks the position of the cross plate. The cross plate includes an off-centered threaded aperture to accept a bolt. The bolt is adapted to be threaded through the aperture until it makes firm contact with the door or doorjamb.

8 Claims, 2 Drawing Sheets

PORTABLE AUXILIARY DOOR LOCK

FIELD OF THE INVENTION

The present invention relates to portable auxiliary locking devices that provide additional security to locked doors.

BACKGROUND OF THE INVENTION

Most doors include one or more of a variety of key operated locks to prevent unauthorized entry. However, there often exists the need for additional security. For example, auxiliary locking devices are useful for augmenting the security of doors in homes, apartments and hotel and motel rooms which are accessible with master keys.

There is also a need for providing additional security to doors which are equipped with conventional locks consisting of a horizontal latch bolt which extends into a latch hole in a doorjamb, without making structural changes to the door.

There is further a need for an auxiliary locking device which is portable and easily removable and operates without a key.

SUMMARY OF THE INVENTION

The present invention is a portable reusable locking device for use with a door hung in a frame including a vertically extending doorjamb having a latch hole. The locking device when in place provides additional security by making it more difficult to force the door open. The locking device is affixed from the inside of a door using the existing latch hole, doorjamb, and door. A portion of the locking device fits within a narrow gap between the side edge of the door and the doorjamb when the door is closed.

The subject locking device comprises a rigid flat plate dimensioned to fit in the gap between the door and doorjamb. The locking device extends from the latch hole a distance inside the door clear of the doorjamb and door when the door is closed. A tongue, extending transversely from one end of the plate, is dimensioned to fit substantially within the latch hole. Crossbar means releasably securable to the plate extends across a portion of the door and a portion of the doorjamb when the door is closed. A point of contact means, extending transversely from the crossbar means and spaced from the plate, provides a firm point of contact between the crossbar and the door or doorjamb.

The point of contact means preferably comprises a threaded rod dimensioned to fit in an aperture in the crossbar means. The crossbar means preferably comprises a flat cross plate, having a series of vertically extending slots dimensioned to receive the cross plate.

The present invention is believed to be simple and inexpensive to manufacture, able to provide positive contact to uneven door and doorjamb surfaces, and able to limit forceable entries. The present invention does not structurally alter the door when installed.

BRIEF DESCRIPTION OF THE DRAWINGS

The invention will now be described by way of example only, with reference to the following drawings, in which.

DETAILED DESCRIPTION OF THE PREFERRED EMBODIMENT

Figure 1:
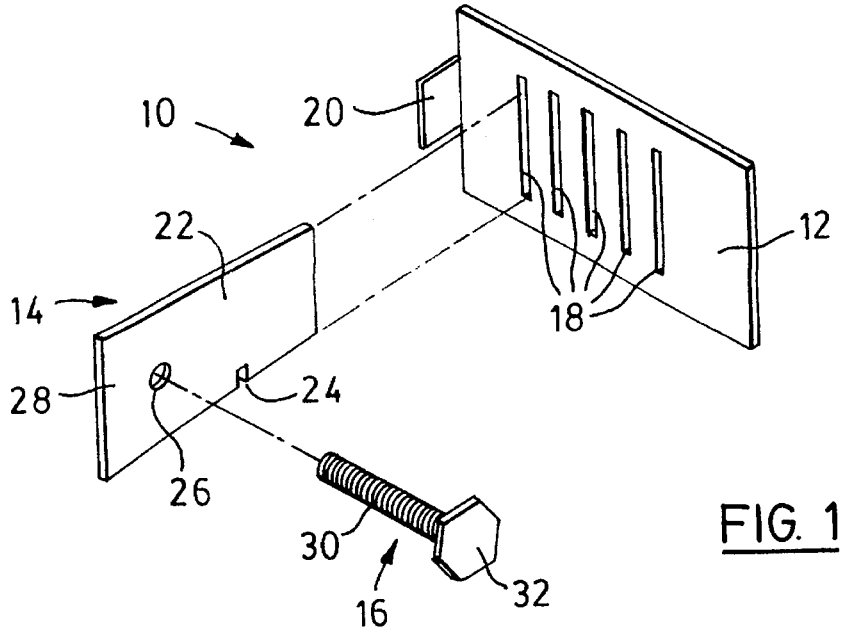
FIG. 1 is an exploded perspective view of a preferred embodiment of the present invention.

Referring to FIG. 1, the present invention is a locking device, comprising a flat plate 12, crossbar means 14, and point of contact means 16.

Figure 2:
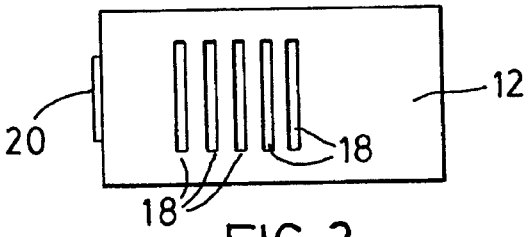
FIG. 2 is a side elevational view of the plate and tongue shown in FIG. 1.

As shown in FIG. 2, plate 12 is provided with a series of spaced vertically extending slots 18. Tongue 20 extends transversely from one end of plate 12.

Figure 3:
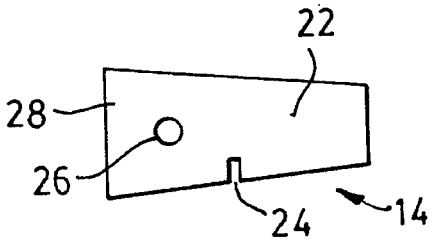
FIG. 3 is a front elevational view of the cross plate shown in FIG. 1.

Referring now to FIG. 3, crossbar means 14 preferably takes the form of a cross plate 22, having a notch 24 in the bottom edge, and an off-center threaded aperture 26.

Figure 4:
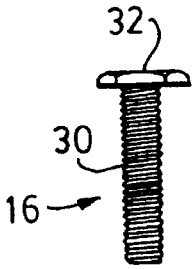
FIG. 4 is an elevational view of the bolt shown in FIG. 1.

As shown in FIG. 4, point of contact means 16 preferably comprises a threaded rod such as bolt 30, having a head portion 32, and a threaded portion dimensioned to fit within aperture 26.

Figure 5:
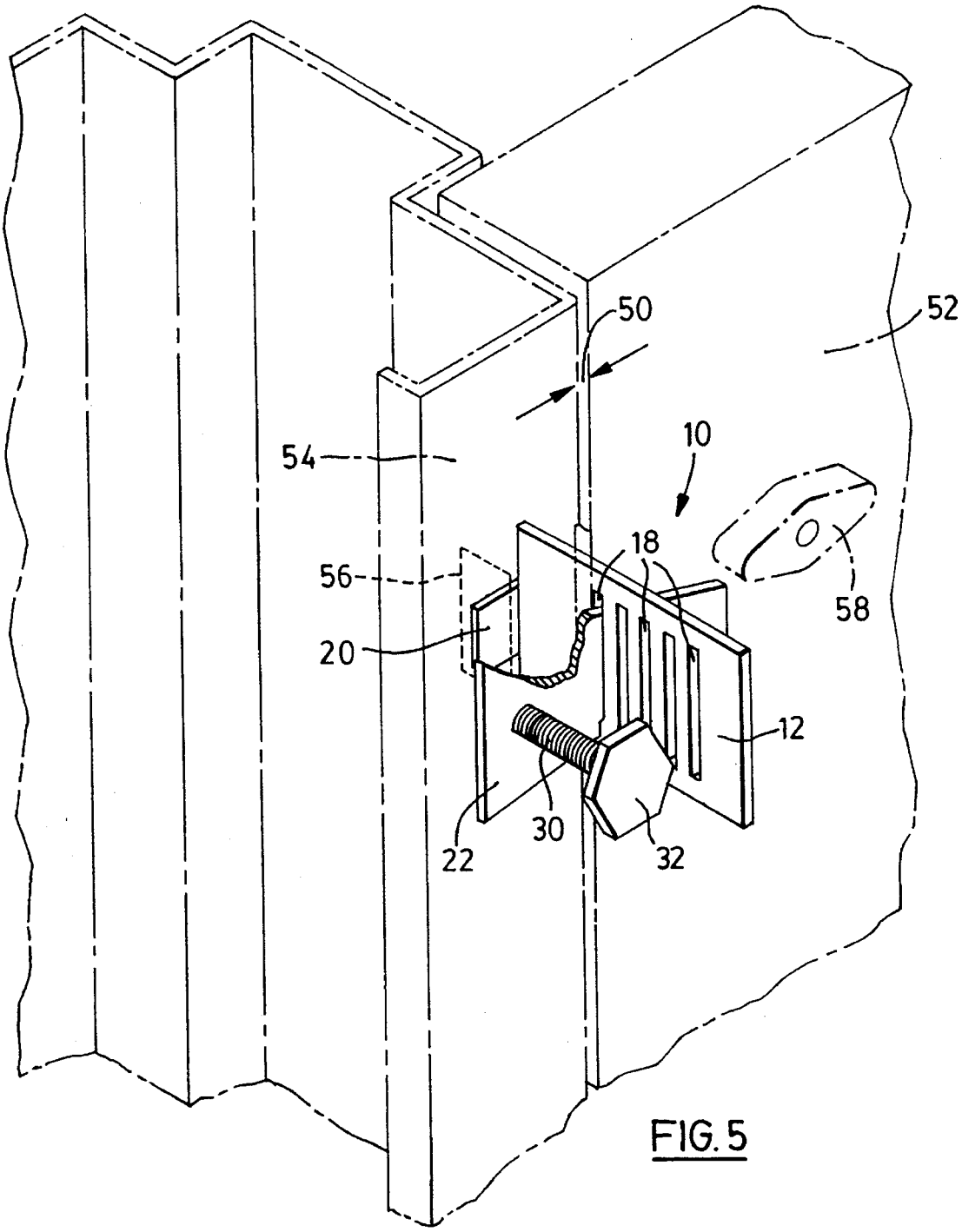
FIG. 5 is a cutaway perspective view showing the preferred embodiment of the invention deployed on a door and doorjamb.

Referring now to FIG. 5, locking device 10 is shown deployed on door 52 and doorjamb 54, shown in ghost lines. Door 52 is hung in a frame comprising doorjamb 54 having a latch hole 56, adapted to receive a latch bolt (not shown), which is extended into latch hole 56 by operation of handle 58. Plate 12 must be thin enough to fit in the narrow gap 50, formed between the side edge of door 52 and doorjamb 54, when door 52 is closed. Plate 12 must also be long enough to extend from latch hole 56 to a distance clear of door 52 and doorjamb 54, when door 52 is closed.

Slots 18 in plate 12 are preferably spaced over a preselected distance which enables the locking device 10 to be used with doors and doorjambs of varying thicknesses. The length and width of tongue 20 are selected so that tongue 20 fits within latch hole 56, when door 52 is closed. Tongue 20 is also preferably thin enough to fit alongside the latch bolt (not shown) when handle 58 is operated and the latch bolt is extended into latch hole 56.

Notch 24 in cross plate 22 is slightly wider than the thickness of plate 12, and is adapted to engage a portion of plate 12 below slot 18 so as to lock cross plate 22 into position, as it is slid into slot 18. Cross plate 22 is preferably tapered in width such that the wider end 28 is wider than slots 18. Notch 24 is preferably centered along the bottom edge of cross plate 22. When deployed, cross plate 22 extends across a portion of door 52, and a portion of doorjamb 54. Cross plate 22 can be inserted from the doorjamb side as depicted or the door side.

Bolt 30 extends transversely through a threaded aperture 26 in cross plate 22, so as to make firm contact with doorjamb 54 as shown in FIG. 5, or with door 52, when locking device 10 is deployed. Head 32 of bolt 30 is preferably adapted to be tightened by hand.

In a preferred embodiment, plate 12, tongue 20 and cross plate 22 are made of sheet steel. Plate 12 may have a length of 2.75", a width of 1.5", a thickness less than 2 mm, and a series of five vertical slots dimensioned 2 mm wide and 14 mm long, spaced over a distance of about 1.25". Tongue 20 may have a length of 0.5", a width of 0.625" and a thickness of 0.9 mm. Tongue 20 may be formed by bending a portion of plate 12 transversely to plate 12, and reducing its thickness. Cross plate 22 may be 2.375" long, 1.0" wide at the wide end 28, and 0.625" at the narrow end. Notch 24 centered on the bottom edge, may be 2 mm wide and 5 mm deep. Off center threaded aperture 26 may be 8 mm in diameter. Steel bolt 30 may have a length 1.5", a diameter of 8 mm, and a large hexagonal head 32.

In use, plate 12 is placed flush against the side edge of doorjamb 54, such that tongue 20 extends into latch hole 56. While holding plate 12 in this position, door 52 is closed, leaving the middle portion of plate 12 in gap 50, and the other end portion of plate 12 extending inside the door 52 clear of door 52 and doorjamb 54. The narrow end of tapered cross plate 22 is inserted into the slot 18 that is closest to the surface of door 52 and doorjamb 54, either from the door 52 or doorjamb 54 side of plate 12, so as to minimize the clearance between cross plate 22 and door 52 and doorjamb 54. Cross plate 22 is inserted until notch 24 engages the plate 12 below slot 18, thereby locking the position of cross plate 22 relative to plate 12. Bolt 30 is then screwed by hand into threaded aperture 26 in cross plate 22 until contact is made with door 52 or doorjamb 54 (as depicted in FIG. 5), thereby positioning locking device 10 firmly in place.

When deployed on a locked door by a person inside an apartment, hotel room or the like, locking device 10 prevents an intruder with a master key from gaining unauthorized entry through the door. Further, in cases in which bolt 30 is secured against doorjamb 54, an attempt at forced entry will result in the door banging against cross plate 22, creating an audible sound and thereby alerting the person inside the room.

As will be apparent to persons skilled in the art, various modifications and adaptations of the structure described above are possible without departure from the present invention, the scope of which is defined in the appended claims.

I claim:

1. A locking device for use with a door hung in a frame including a vertically extending doorjamb having a latch hole aligned to receive a latch bolt, there being a narrow gap between the side edge of the door and the doorjamb when the door is closed, the locking device comprising:

(a) a rigid flat plate dimensioned to fit in the gap, and to extend from the latch hole a distance inside the door clear of the door and doorjamb when the door is closed;

(b) a tongue extending transversely from one end of the plate dimensioned to fit within the latch hole;

(c) crossbar means releasably securable to the plate for extending across a portion of the door and a portion of the doorjamb when the door is closed;

(d) point of contact means extending transversely from the crossbar means and spaced from the plate for providing a firm point of contact between the crossbar means and the door or doorjamb;

(e) wherein the point of contact means comprises a threaded rod dimensioned to fit in a threaded aperture in the crossbar means; and (f) wherein the crossbar means comprises a flat cross plate.

2. The locking device defined in claim 1, wherein the cross plate has a tapered width.

3. The locking device defined in claim 1, wherein the threaded rod is a bolt having a head adapted to be tightened by hand.

4. The locking device as defined in claim 1, wherein the tongue is thin enough to fit in the latch hole along with the latch bolt.

5. The locking device defined in claim 1, wherein the plate has at least one slot dimensioned to receive the cross plate.

6. The locking device defined in claim 5, wherein the cross plate has a notch in a bottom portion thereof wider than the thickness of the plate.

7. The locking device defined in claim 5, wherein the plate has a series of spaced slots to accommodate doors and doorjambs of various thicknesses.

8. A locking device for use with a door hung in a frame including a vertically extending doorjamb having a latch hole aligned to receive a latch bolt, there being a narrow gap between the side edge of the door and the doorjamb when the door is closed, the locking device comprising: a sheet steel plate dimensioned to fit in the gap, and to extend from the latch hole a distance inside the door clear of the doorjamb when the door is closed; the plate having a series of spaced slots, spaced to accommodate doors and doorjambs of various thicknesses; a sheet steel tongue formed from the plate and extending transversely from one end of the plate dimensioned to fit within the latch hole; a sheet steel cross plate with a tapered width dimensioned to slide into the spaced slots; the cross plate having a notch in the bottom edge thereof dimensioned to register with the plate; wherein the cross plate extends across a portion of the door and a portion of the doorjamb when the door is closed; wherein the cross plate has a threaded aperture spaced from the plate; and a steel bolt dimensioned to fit in the aperture having a head adapted to be hand tightened to make firm contact with the door or doorjamb.

* * * * *